US005641125A

United States Patent [19]

Martin et al.

[11] Patent Number: 5,641,125

[45] Date of Patent: Jun. 24, 1997

[54] NOZZLE ASSEMBLY INCLUDING A NOZZLE CAP AND A UNITARY NOSE BUSHING

[75] Inventors: Douglas S. Martin, Forest City, N.C.; Wilhelmus J. J. Maas; Petrus L. W. Hurkmans, both of Someren, Netherlands

[73] Assignee: AFA Products, Inc., Forest City, N.C.

[21] Appl. No.: 394,008

[22] Filed: Feb. 23, 1995

Related U.S. Application Data

[63] Continuation-in-part of Ser. No. 177,685, Jan. 5, 1994, abandoned.

[51] Int. Cl.[6] ..... B05B 1/34

[52] U.S. Cl. ..... 239/481; 239/493; 239/333; 222/383.1

[58] Field of Search ..... 239/333, 481, 239/492, 491, 579, 581.2, 539; 222/383

[56] References Cited

U.S. PATENT DOCUMENTS

| | | | |
|---|---|---|---|
| 3,967,765 | 7/1976 | Micallef | 222/554 |
| 4,220,285 | 9/1980 | Gualdi | 239/333 X |
| 4,234,128 | 11/1980 | Quinn et al. | 239/478 |
| 4,313,569 | 2/1982 | Burke | 239/333 |
| 4,503,998 | 3/1985 | Martin | 239/333 X |
| 4,516,695 | 5/1985 | Garneau | 239/478 X |
| 4,640,444 | 2/1987 | Bundschuh | 239/333 X |
| 4,890,792 | 1/1990 | Martin et al. | 239/478 X |
| 4,911,361 | 3/1990 | Tada | 239/333 X |
| 4,991,778 | 2/1991 | Maas et al. | 239/333 |
| 5,234,165 | 8/1993 | Foster et al. | 239/333 |
| 5,526,985 | 6/1996 | Martin | 239/478 |

FOREIGN PATENT DOCUMENTS

| | | | |
|---|---|---|---|
| 60-183056 | 9/1985 | Japan . | |
| 60-44023 | 10/1985 | Japan . | |
| 92-007660 | 5/1992 | WIPO | 239/333 |

*Primary Examiner*—Lesley D. Morris
*Attorney, Agent, or Firm*—Thomas R. Vigil

[57] ABSTRACT

The nozzle assembly comprises two pieces, they being: a nozzle cap; and, an integral nose bushing on which the nozzle cap is threadedly received. The integral nose bushing includes a body portion received and mounted in a body of a trigger sprayer and a bushing portion integral with the bushing portion. The bushing portion includes a generally cylindrical portion having a distal end and a proximal end with the proximal end having threads thereon and the distal end having a smooth outer cylindrical surface. The cylindrical portion has an annular slot therein defining an outer cylindrical flange and a central cylindrical portion. The central cylindrical portion has an outer end which extends outwardly of the outer cylindrical flange and which has an outer end having an annular wall defining therein a swirl cavity. The nose bushing has a passage therein communicating a waterway in the bushing portion with the annular slot in the cylindrical portion. The nozzle cap includes a generally cylindrical skirt formation extending rearwardly from a front wall of the cap having an orifice extending through the front wall. The generally cylindrical skirt formation includes an internal threaded portion which is adapted to mate with threads on the threaded portion of the nose bushing. The nozzle cap also has, on a rear surface of the front wall, an axially, rearwardly extending annular projection which surrounds the orifice and which is sized to be received in and seal with the walls of the swirl cavity.

17 Claims, 5 Drawing Sheets

NOZZLE ASSEMBLY INCLUDING A NOZZLE CAP AND A UNITARY NOSE BUSHING

CROSS REFERENCE TO RELATION APPLICATIONS

This application is a continuation-in-part of U.S. application Ser. No. 08/177,685 filed on Jan. 5, 1994 now abandoned.

BACKGROUND OF THE INVENTION

1. Field of the Invention

The present invention relates to an adjustable nozzle assembly comprising only two pieces for mounting to a trigger sprayer which is used in dispensing liquids and more particularly to a nozzle assembly including only a unitary nose bushing which is made of a relatively hard plastic material and a nozzle cap which is also made of a relatively hard plastic material and which is axially adjustable on the nose bushing between an OFF mode position, a SPRAY mode position and a STREAM mode position.

2. Description of the Related Art Including Information Disclosed under 37 CFR §§ 1.97–1.99

Heretofore, various nozzle assemblies for a trigger sprayer have been proposed which are adjustable to provide varying discharge patterns, i.e. a spray pattern and a stream pattern.

Examples of analogous and non-analogous prior art adjustable nozzle assemblies for selectively dispensing a liquid in a spray or stream mode, are disclosed in the following U.S. Patents, Japanese published patent applications, PCT published patent application and Taiwanese published patent applications:

| U.S. Pat. No. | Patentee |
|---|---|
| 3,967,765 | Micallef |
| 4,220,285 | Gualdi |
| 4,313,569 | Burke |
| 4,503,998 | Martin |
| 4,640,444 | Bundschuh |
| 4,911,361 | Tada |
| 4,991,778 | Maas |
| 5,234,166 | Foster et al. |
| Japanese Patent Application No. | Applicant |
| 57-192 076 | Canyon Corporation |
| 59-36177 | Canyon Corporation |
| PCT Publication No. | Applicant |
| WO 92/07660 | Foster et al. |
| Taiwanese Patent Application No. | Applicant |
| 81101823 | Thomann |
| 82211671 | Chang |

The Maas et al. U.S. Pat. No. 4,991,778 discloses an adjustable nozzle assembly for a trigger sprayer comprising a nose bushing and a nozzle cap which is screwed on the nose bushing. The nozzle cap has a discharge orifice in a front face and a flanged skirt extending from a front wall thereof. The flanged skirt is threaded inside a rear portion thereof and an internally specially contoured stepped surface is located forwardly of the threads to provide reduced diameter, annular surfaces at two locations rearward of an inner face of the front wall of the cap.

The nozzle cap is selectively threadably positionable on the nose bushing between three selected positions such that positioning of the inner wall surface and the inner annular surfaces of the nozzle cap flange skirt selectively cooperate with a front face and an annular periphery of a nose bushing face disk having two angular grooves in the annular periphery thereby selectively to provide a stop mode position for containment of liquid, a spray mode position to discharge liquid in a spray pattern and a stream mode position to discharge liquid in a stream pattern from the discharge orifice.

The Foster et al. U.S. Pat. No. 5,234,166 discloses a spinner assembly for a sprayer. The spinner assembly is fitted to a discharge nozzle or nose bushing and includes an annular chamber surrounding a central post having a swirl chamber at an outer end thereof. A nozzle cap variably engages the discharge nozzle and has a central projection on an inner side of a front wall thereof and an annular groove defined by a shoulder surrounding the central projection. The central projection can seal against the floor and/or annular wall of the swirl chamber and the annular groove can seal over the annular wall.

Japanese Published Patent Application No. 57-192 076 discloses a dispenser having a cylindrical spinner, a nozzle cap and a nozzle base. The spinner is located at an end of the nozzle base. The nozzle base has an annular wall at an end thereof having an inner circumferential surface. A projection on the inside of the spinner is received within and seals against the inner circumferential surface of the annular wall of the nozzle base. A swirl chamber is formed in the area between the projection on the inside of the nozzle cap and a front wall of the spinner.

Japanese Published Patent Application No. 59-361 77 discloses a spinner assembly which is integral with an annular section of a bushing and is fitted over an open end of a piston. The spinner has a base portion with apertures therethrough which open into a diverging annular passageway defined between a center post of the spinner, which appears to taper inwardly and forwardly so as to have a partially conical shape, and an outer flange or spinner body which tapers outwardly to form an annular chamber which is larger in cross section than the apertures. The spinner head post has an annular wall at an end thereof and the annular wall has a passage therethrough communicating with a swirl chamber.

A nozzle cap receives the annular wall at the downstream end of the spinner head with an inner circumferential surface of the annular wall sealing against a peripheral section of a projection extending inwardly from the back side of the nozzle cap. The projection is ring shaped and seals in an annular groove in the bottom of the swirl cavity at the downstream end of the post of the spinner head. The annular groove has a partially cylindrical section that meets with a rounded end of the projection or annular section.

Heretofore difficulties have been encountered in manufacturing an adjustable threaded nozzle cap and nose bushing assembly. These difficulties center around two problems, they being: 1) how to maintain a liquid seal between the nozzle cap and the nose bushing and 2) how to provide ease or relative rotation or turning of the nozzle cap on the nose bushing.

When using hard plastic materials, it is difficult to create matching sealing surfaces which will not leak over time particularly in the case where the hard mating surfaces of the rigid plastic parts are formed by injection molding. This difficulty is complicated by the fact that plastic parts in confinement take on a "set" and, as a result of the "set", they do not maintain their original assembled position and this eventually leads to leaking of fluid between mating plastic parts in a nozzle assembly.

It has been found to be difficult and complicated to meet the requirement of having two assembled hard rigid plastic parts that can be rotated reasonably easily with respect to each other by hand when trying to meet the objective of creating and maintaining a liquid seal between mating hard plastic surfaces. In other words, as you attempt to make the fit between the hard sealing surfaces a tight interference fit to create a liquid seal, the mating hard rigid plastic parts often fit so tightly that they cannot rotate easily between each other.

The objective of providing a good liquid seal between hard plastic parts in a nozzle assembly and yet have ease of rotation between the nozzle cap and other parts of the assembly has been achieved in the past by providing more than two parts, namely by adding a third part, and by making the third part of a softer material, such as out of polyethylene or EVA. The part made of this softer plastic material, although it takes a set, retains a memory of its original molded construction and together with lip seals formed therein easily will make a good seal with a hard plastic part over a short period of time. The softness of the additional part also allows for ease of rotation of a nozzle cap relative to the softer plastic part.

For example, in the Burke U.S. Pat. No. 4,313,569 a nozzle cap threaded to the barrel of a pump can easily rotate relative to a nozzle seal having an annular sealing lip which is positioned between the pump barrel and the nozzle cap and which is made of a softer plastic material than the nozzle cap.

In a similar manner, the Martin U.S. Pat. No. 4,503,998 provides an elastic cup member positioned between a nozzle cap and a nose bushing having a cavity which receives a channel-defining insert which cooperates with the elastic cup member and the nozzle cap to control the output of a trigger operated pump.

In the Maas et al. U.S. Pat. No. 4,991,778, a rubber O-ring creates a seal between a nozzle cap made of polypropylene and a nose bushing made of polypropylene.

Further, the Foster et al. U.S. Pat. No. 5,234,166 teaches the provision of a separate one piece spinner assembly made of a soft plastic material and having a spinner head at an outer end thereof that engages a projection that extends rearwardly from the inner surface of a front wall of a nozzle cap made of a harder plastic material. The spinner assembly, and particularly a spring and valve portion thereof, are received in a nozzle fluid chamber in a nose bushing/nozzle on which the nozzle cap is threadedly received.

As will be described in greater detail hereinafter, the two piece nozzle assembly of the present invention provides sealing between and ease of relative rotation between only two hard plastic parts, they being a nozzle cap and an integral unitary nose bushing, without the need of a third part made of a softer plastic material.

SUMMARY OF THE INVENTION

According to the present invention there is provided a nozzle assembly comprising two parts, they being: a nozzle cap; and, an integral nose bushing on which the nozzle cap is threadedly received. The integral nose bushing includes a body portion that is adapted to be received and mounted in a body of a trigger sprayer and a bushing portion. The body portion is integral with the bushing portion. The bushing portion includes a generally cylindrical portion having a distal end and a proximal end with the proximal end having threads thereon and the distal end having a smooth outer cylindrical surface. The cylindrical portion has an annular slot therein thereby defining an outer cylindrical flange and a central cylindrical portion. The central cylindrical portion includes an outer end which extends outwardly of the outer cylindrical flange and which outer end has an annular wall defining therein a swirl cavity. The bushing portion has a waterway extending longitudinally through the bushing portion to at least an area adjacent the annular slot. The nose bushing has a passage in the integral nose bushing communicating the waterway with the annular slot in the cylindrical portion. The nozzle cap includes a generally cylindrical skirt formation extending rearwardly from a front wall of the cap with the front wall having an orifice extending through the front wall. The generally cylindrical skirt formation includes an internal threaded portion which is adapted to mate with threads on the threaded portion of the nose bushing and the nozzle cap has, on a rear surface of the front wall, an axially rearwardly extending annular projection which surrounds the orifice and which is sized to be received in and seal with the walls of the swirl cavity.

Preferably the nozzle cap has an axially extending annular slot which extends from a back side of the cap into the cap and which is constructed and arranged to receive the cylindrical flange of the integral nose bushing and seal with the inner and outer cylindrical surfaces thereof.

DESCRIPTION OF THE PREFERRED EMBODIMENT(S)

Figure 1:
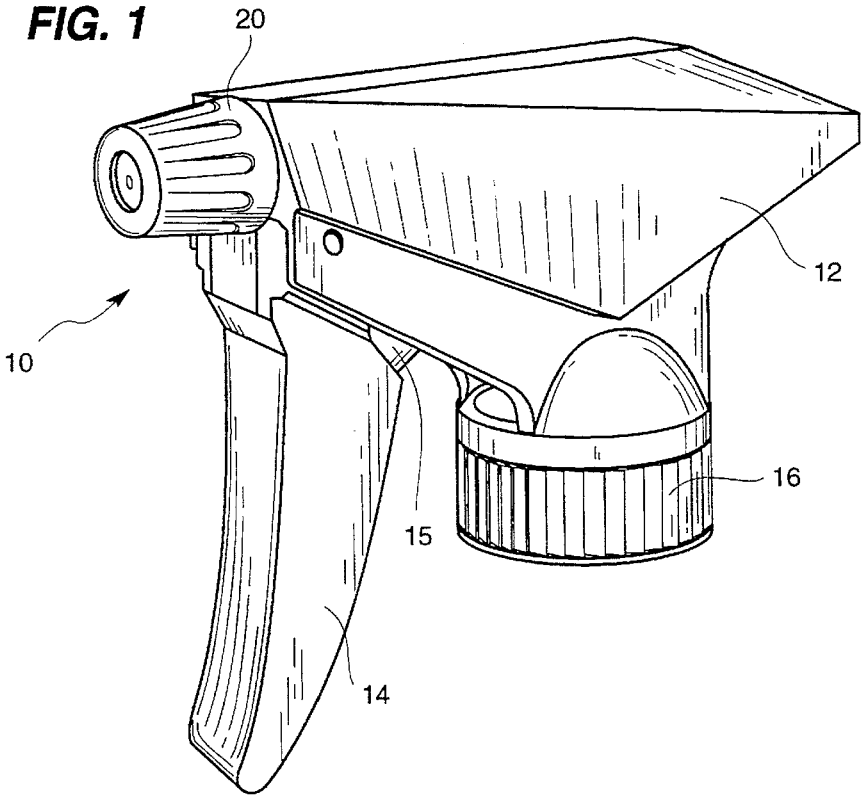
FIG. 1 is a perspective view of a trigger sprayer having an adjustable nozzle assembly constructed according to the teachings of the present invention and shows a nozzle cap of the nozzle assembly threadedly attached to a unitary nose bushing (hidden in this view) mounted to the body of the trigger sprayer.

Referring now to FIG. 1, there is illustrated therein, a trigger sprayer 10 including a housing 12, a trigger 14 pivotally mounted to the housing 12 for acting against a piston 15 received in a cylinder (hidden from view) in the housing 10 and a bottle cap 16 for mounting the sprayer 10 to a container of liquid in a conventional manner. Mounted to the front end of the sprayer housing 12 is an adjustable nozzle assembly 18 constructed according to the teachings of the present invention.

Figure 2:
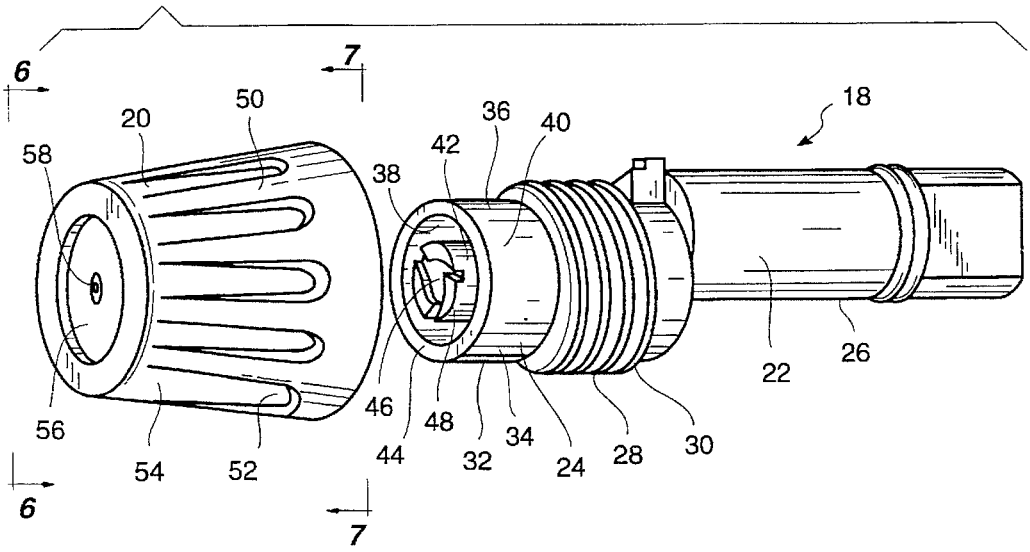
FIG. 2 is an exploded perspective view of the adjustable nozzle assembly including the nozzle cap and the unitary nose bushing.

The adjustable nozzle assembly 18, shown exploded in FIG. 2, comprises a nozzle cap 20 and an integral nose bushing 22. The nozzle cap 20, shown in FIG. 1, is mounted to the integral nose bushing 22, which is mounted to the sprayer housing 12.

The cap 20 and the integral nose bushing 22 are shown unassembled in FIG. 2. As shown, the integral nose bushing 22 includes a forwardly extending bushing portion 24 and a rearwardly extending cylindrical body portion 26 which is received in an opening (not shown) in the sprayer housing 12. Threads 28 are provided on a proximal part 30 of the bushing portion 24 of the integral nose bushing 22 so that the nozzle cap 20 can be threadedly attached to the integral nose bushing 22.

A distal part 32 of the bushing portion 24 of the integral nose bushing 22 includes a cylindrical extension 34 having a smooth outer cylindrical surface 36. The cylindrical extension 34 has an axially extending annular space 38 therein which defines, on the outer edge of the space, an outer annular flange 40 and, on the inner side of the space, an inner central cylindrical projection 42 both of which are integral with the nose bushing 22.

The central cylindrical projection 42 extends outwardly from the proximal part 30 of the bushing portion 26 beyond a distal end 44 of the outer cylindrical flange 40. A swirl cavity 46 is provided at and in an outer end 48 of the central cylindrical projection 42, i.e. in an annular wall 80 (FIGS. 3 and 4) at the outer end 48.

Figure 6:
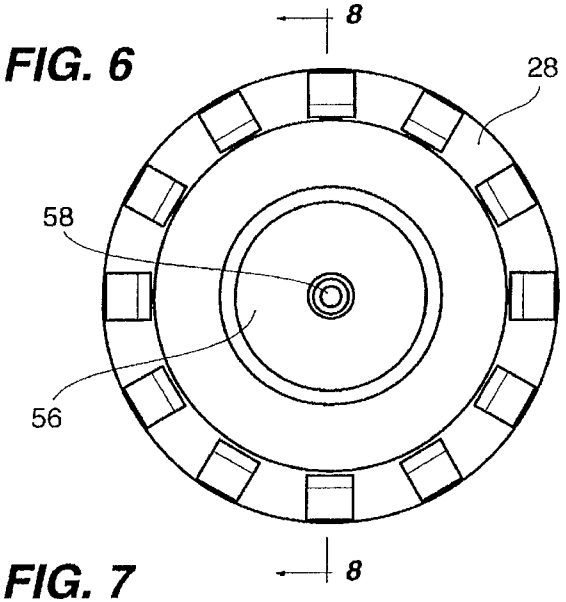
FIG. 6 is a front end view of the nozzle cap shown in FIG. 2 and is taken along line 6—6 of FIG. 2.
Figure 7:
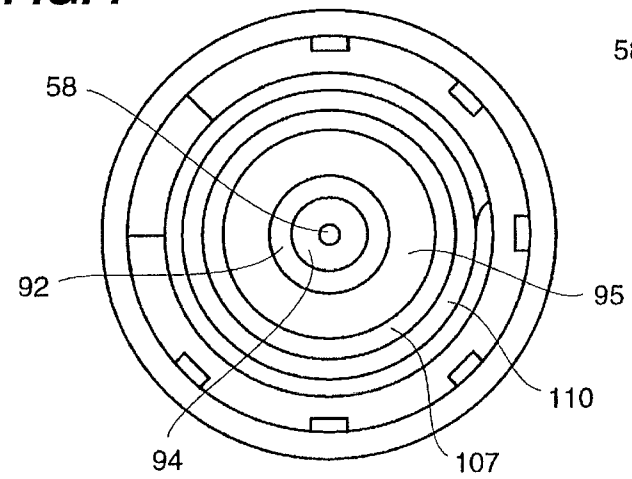
FIG. 7 is a rear end view of the nozzle cap shown in FIG. 2 and is taken along line 7—7 of FIG. 2.

As shown in FIG. 2, the nozzle cap 20 of the nozzle assembly 18 includes a generally cylindrical outer skirt 50 having flutes 52 in an outer surface 54 thereof. The flutes 52 facilitate gripping and rotating of the cap 20 when the cap 20 is mounted on the integral nose bushing 22. The cap 20 further includes a front wall 56 having a discharge orifice 58 therein. The nozzle cap 20 is described in greater detail below in connection with the description of FIGS. 6–8.

Figure 3:
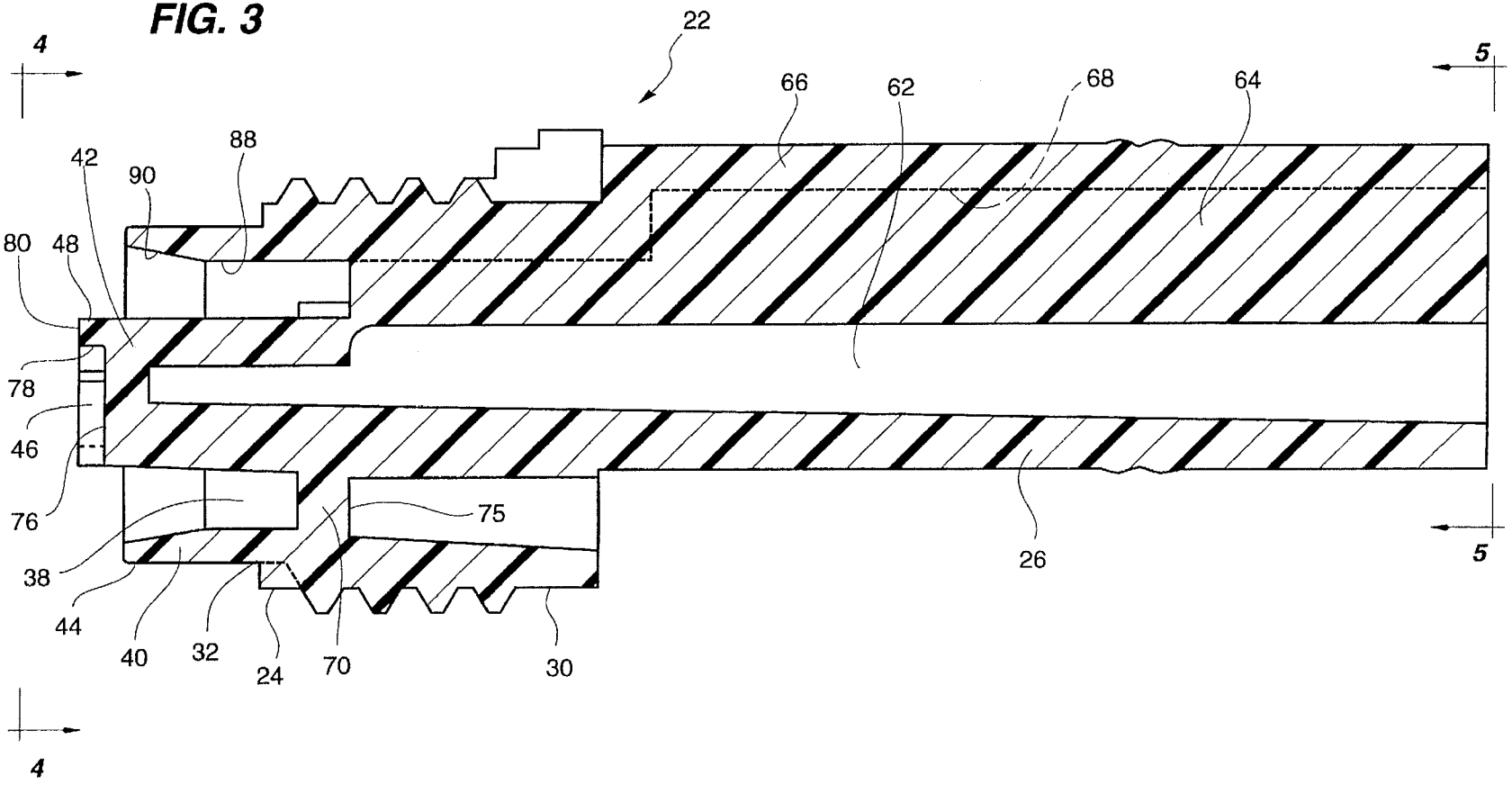
FIG. 3 is a longitudinal sectional side view of the unitary nose bushing 2.

As shown in FIG. 3, the cylindrical body portion 26 of the integral nose bushing 22 has a waterway 62 which extends, longitudinally, to at least an area adjacent to the axially extending annular space 38 in the bushing portion 28. The waterway 62 begins in the body portion 26 of the integral nose bushing 22 and extends into the proximal part 30 of the bushing portion 24 of the integral nose bushing 22.

An axially extending vertical wall 64 extends downwardly from a top side 66 of an inner surface 68 of the waterway 62. The vertical wall 64 extends axially the entire length of the waterway 62, parallel to a longitudinal axis of the waterway 62.

An internal wall 70 in the bushing portion 24 separates the proximal part 30 of the bushing portion 22 from the distal part 32 of the bushing portion 22. The internal wall 70 has two cut out sections 72 and 74 forming passages that communicate the annular space 38 in the distal end 44 of the outer cylindrical flange 40 of the bushing portion 24 with the waterway 62. Thus, liquid can pass from the waterway 62, through the two passages 72, 74 in the internal wall 70 into the annular space 38 between the outer cylindrical flange 40 and the central cylindrical projection 42.

The outer end 48 of the central projection 42, which contains the swirl cavity 46, extends slightly beyond the distal end 44 of the outer cylindrical flange 40 of the bushing portion 24. The swirl cavity 46 is defined by a bottom wall 76, which is located at the outer end 48 of the central projection 42, and an inner surface 78 of the annular wall 80 extending forwardly from the peripheral margin of the central projection 42. The annular wall 80 has three tangential slots 82, 84, 86 therein (FIG. 4) to allow liquid to enter the swirl cavity 46 along a tangent from the annular space 38.

An inner surface 88 of the outer cylindrical flange 40 includes an inner tapered surface 90 which tapers radially outwardly to the distal end 44. The tapered surface 90 facilitates the receiving of the nozzle cap 20 onto the integral nose bushing 22 and sealing of the nozzle cap 20 with the nose bushing 22 cylindrical portion 40, as described in greater detail below.

Figure 4:
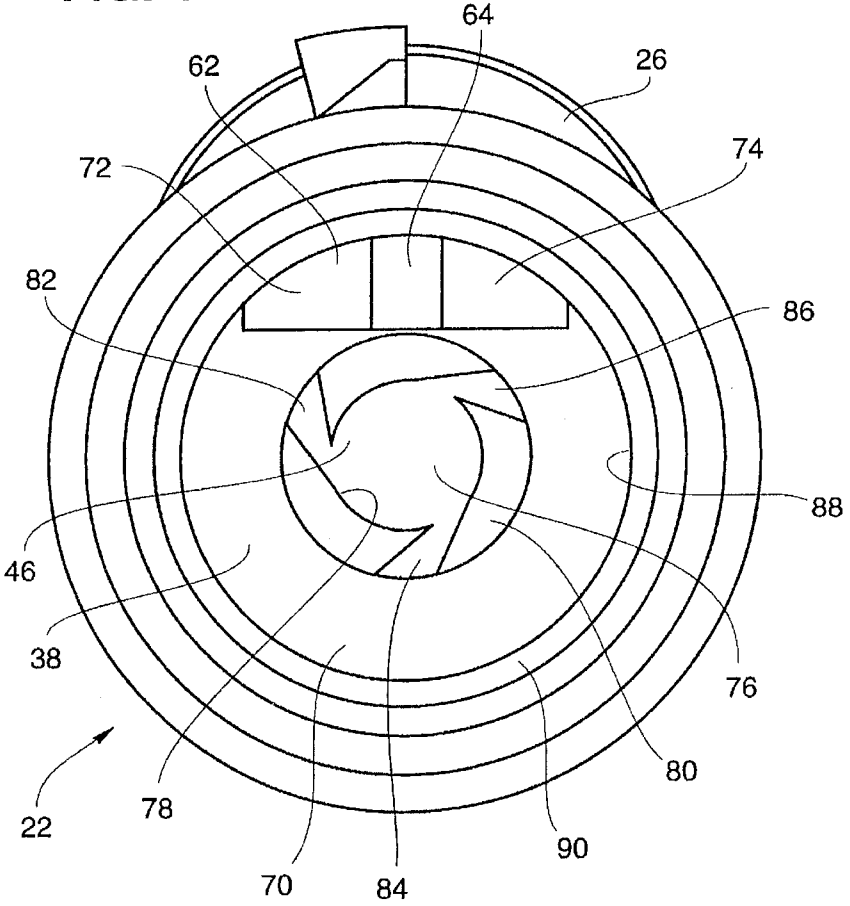
FIG. 4 is a front end view of the unitary nose bushing shown in FIG. 2 and is taken along line 4—4 of FIG. 3.

As shown in FIG. 4, the swirl cavity 46 of the integral nose bushing 22 has the three tangential slots 82, 84, 86 in the annular wall 80 of the central projection 42. Pressurized liquid enters the swirl cavity 46 through these slots 82, 84, 86 when the trigger 14 is squeezed. FIG. 4 also shows the two passageways 72, 74 in the internal wall 70 for connecting the waterway 62 with the annular space 38.

Figure 5:
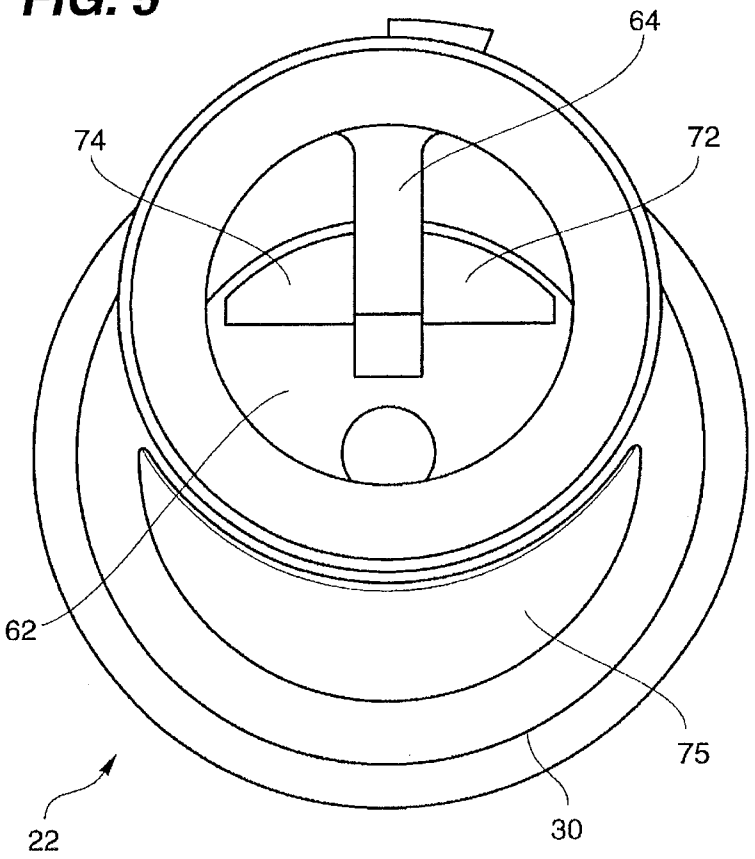
FIG. 5 is a rear end view of the unitary nose bushing shown in FIG. 2 and is taken along line 5—5 of FIG. 3.

In FIG. 5 there is shown a rear view of the integral nose bushing 22. The waterway 62 is shown with the vertical wall 64 extending into the waterway 62 and forming a septum for the two passageways 72, 74 into the annular space 38 in the bushing portion 24 of the integral nose bushing 22.

Figure 8:
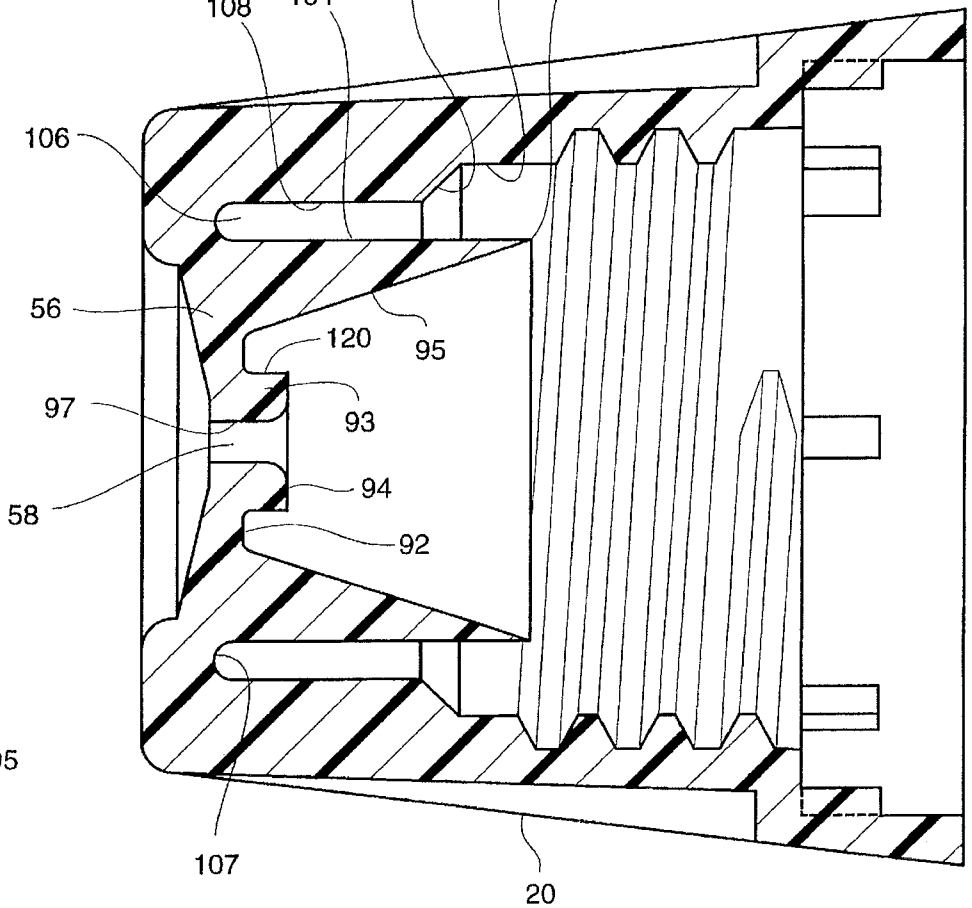
FIG. 8 is a sectional view of the nozzle cap of FIG. 6 and is taken along the lines 8—8 of FIG. 6.

As shown in FIG. 8, the front wall 56 has a rear surface 92 having a short cylindrical projection 93 extending rearwardly therefrom to a planar surface 94. The discharge orifice 58 opens onto the surface 94. The inside of the nozzle cap 20 flares radially outwardly from the rear surface 92 along a generally conical or tapered wall surface 95 to a sharp edge 96. As shown, the orifice 58 has a tapered or curved surface 97 curving radially outwardly to open onto the annular end surface 94 to facilitate the flow of liquid into the discharge orifice 58. The projection 93 is also sized to fit within the swirl cavity 46 in a sealing manner.

The tapered wall surface 95 extends rearwardly from the rear surface 92 and is located radially outwardly from the cylindrical projection 93. The tapered wall surface 95 tapers to the sharp edge 96 formed with an annular wall 104 of an axially extending slot 106 which extends forwardly into the cap 20 to a rounded, annular or toroidially shaped bottom 107.

The annular slot 106 is defined in the cap 20 in the area between an inner wall 108 of the threaded outer skirt 50 and the annular wall 104.

A stepped outer annular wall surface 110 of the outer skirt 50 is connected by a tapered or conical wall surface 111 of the skirt 50 to the wall 108. The stepped wall surface 110 is adapted slidingly to receive the outer cylindrical flange 40 at the distal end 32 of the bushing portion 24 of the nose bushing 22 when the cap 20 is rotated to a fully sealed position on the nose bushing 22.

Figure 9:
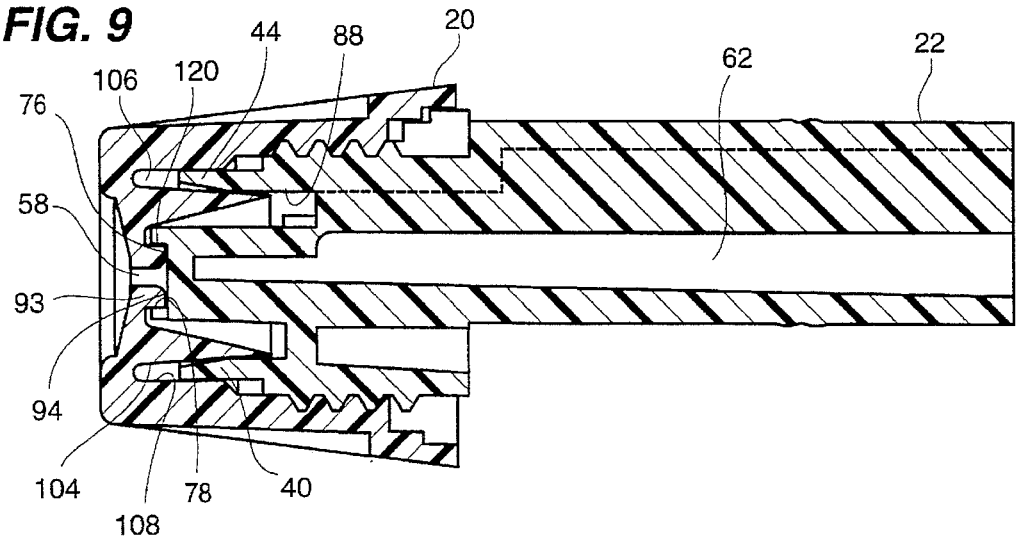
FIG. 9 is a longitudinal sectional view through the nozzle assembly including the nozzle cap and unitary nose bushing assembled to a fully threaded, first or OFF position.
Figure 10:
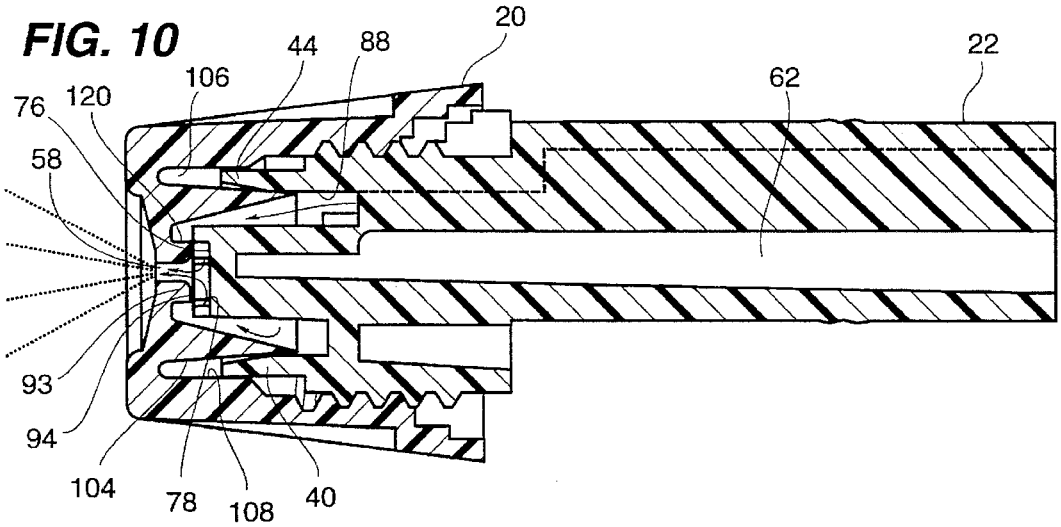
FIG. 10 is a longitudinal sectional view of the nozzle assembly, similar to the view shown in FIG. 9, but showing the nozzle cap partially rotated away from the fully threaded position shown in FIG. 9 to a second or SPRAY position where liquid can exit in a spray.
Figure 11:
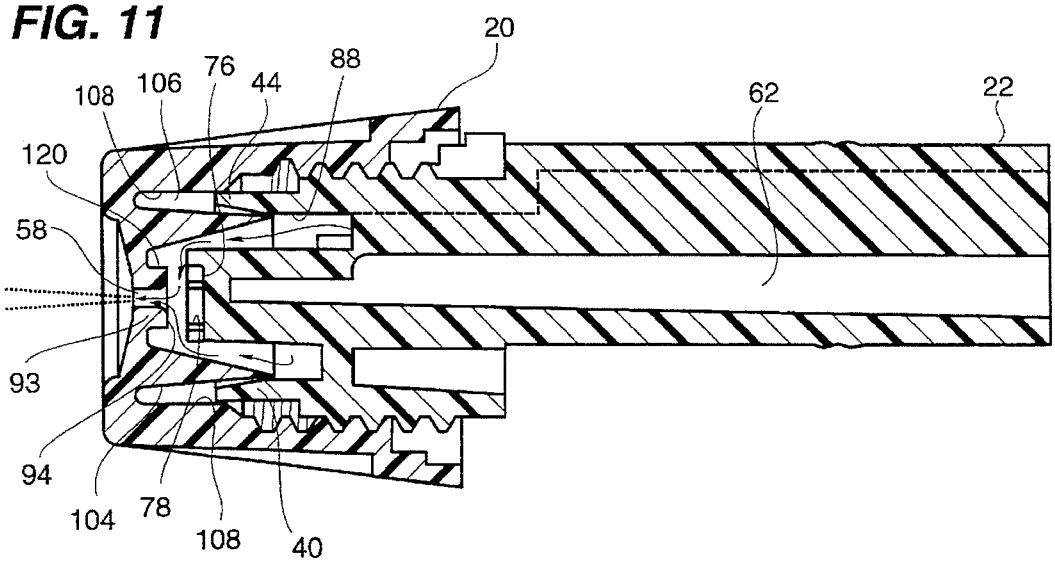
FIG. 11 is a longitudinal sectional view of the nozzle assembly, similar to the view shown in FIG. 10, but showing the nozzle cap further rotated away from the unitary nose bushing to a threaded, or STREAM position where liquid can exit in a stream.

FIGS. 9, 10, and 11 show the OFF, SPRAY and STREAM positions of the nozzle cap 20 with respect to the integral nose bushing 22.

In the OFF position shown in FIG. 9, the cap 20 is fully threaded onto the integral nose bushing 22 such that the planar annular surface 94 of the small cylindrical projection 93 forms a first sealing relationship with the bottom wall 76 of the swirl cavity 46 and an outer wall 120 of the small cylindrical projection 93 forms a second sealing relationship with the inner surface 78 of the annular wall 80 of the swirl cavity 46.

The second sealing relationship between the outer wall 120 of the small cylindrical projection 93 and the inner surface 78 of the swirl cavity 46 blocks the three tangential slots 82, 84, 86, thus preventing liquid from entering the swirl cavity 46.

The first sealing relationship blocks the discharge orifice 58 such that fluid cannot enter the discharge orifice 58 from the swirl cavity 46 due to the sealing relationship between the end surface 94 of the small cylindrical projection 93 and the bottom wall 76 of the swirl cavity 46. Thus fluid is prevented from being discharged by both the first and second sealing relationships described above simultaneously.

The annular slot 106 in the nozzle cap 20 is long enough or deep enough to receive the outer cylindrical flange 40 of the bushing portion 24. A third sealing relationship is then formed between the inner and outer surfaces 88 and 36 of the outer cylindrical flange 40 of the bushing portion 24 and the annular walls 104 and 108 of the slot 106 in the nozzle cap 20. This third sealing relationship prevents fluid leakage out of the nozzle assembly 18 and is maintained not only in the OFF position of the nozzle cap 20, but in the SPRAY and STREAM positions as well.

As the nozzle cap 20 is rotated outwardly, as shown in FIG. 10, to a spray position, the first sealing relationship between the end surface 94 of the small cylindrical projection 93 and the bottom surface 76 of the swirl chamber 46 is no longer present. Also, the outer wall 120 of the small cylindrical projection 93 no longer seals the entire axial length of the inner surface 78 of the swirl cavity 46 leaving the swirl cavity 46 in communication with the annular space 38 via the tangential slots 82, 84, 86.

Pressurized liquid now can flow into the swirl cavity 46 through the tangential slots 82, 84, 86. Once in the swirl cavity 46, the liquid swirls within the swirl cavity 46 and exits through the discharge orifice 58 in the front wall 58 of the cap 20 in a SPRAY pattern.

In the SPRAY position shown in FIG. 10, the pressurized liquid can only enter the orifice 58 from the swirl chamber 46 as the second sealing relationship is still partially intact between the outer wall 120 of the small cylindrical projection 93 and the inner surface 78 of the swirl cavity 46 outwardly from the bottom wall 76 of the swirl cavity 46.

The inner surface 88 of the outer cylindrical portion 40 of the bushing portion 24 and the annular wall 104 in the nozzle cap 20 maintain the third sliding and sealing relationship in the SPRAY position. Thus liquid is only allowed to flow in the area between the tapered wall surface 95 and the distal end 44, toward the outer end of the cylindrical flange 40, and liquid will not leak out of the nozzle cap 20 due to the third sealing relationship between the inner surface 88 of the outer cylindrical flange 40 of the bushing portion 24 and the annular wall 104 in the nozzle cap 20.

In the STREAM position shown FIG. 11, the nozzle cap 20 is further rotated outwardly of the nose bushing 22. Fluid can now flow not only through the tangential passages 82, 84, 86 of the swirl cavity 46 but completely around or over the central cylindrical projection 42 of the nose bushing 22 and flow axially directly into the discharge orifice 46 in the front wall 58 of the cap 20. The liquid flowing axially directly from the annular space 38 around the central cylindrical projection 42 of the nose bushing 22 and in front of the short projection 93 and then axially out of the discharge orifice 58, flows in a stream pattern out of the orifice 58.

The sliding and sealing relationship of the inner surface 88 of the outer cylindrical portion 40 and the annular wall 104 of the nozzle cap 20 is still maintained in the STREAM position to prevent leakage of fluid from the nozzle assembly 18.

According to the teachings of the present invention, the objectives of (a) creating and maintaining a liquid seal between a nozzle cap and a nose bushing while at the same time (b) maintaining ease of rotation between the nozzle cap and the nose bushing is achieved by the construction of the nozzle cap 20 and the nose bushing 22 in the manner described above and illustrated in the accompanying drawings. This construction of the nozzle cap 20 and nose bushing 22 provides a double seal design which prevents leakage over time and also provides reasonable ease of turning or rotation between two rigid similar molded plastic components that are molded of a hard plastic material such as polypropylene or one part being made of polypropylene and the other part being made of an acetal copolymer sold under the trademark CELCON® by Hoechst Celanese Corporation of Summit, N.J.

In one preferred embodiment, the nozzle cap 20 and integral nose bushing 22 are made of a polypropylene material having a grade PP-1154 and sold under the trademark ESCORENE® by Exxon Chemical Americas. The properties of this material are as follows:

| | Value |
|---|---|
| General Properties | |
| Melt Flow Rate, g/10 min. | 12 |
| Density, g/cc | 0.90 |
| Water Absorption in 24 hrs. @ 73° F., % | 0.01 |
| Mold Shrinkage, in/in | 0.01–0.02 |
| Mechanical Properties | |
| Tensile @ Yield (2"/min), psi | 4580 |
| Elongation @ Yield (2"/min), psi | 15.6 |
| Secant Flexural Modulus (0.05"), psi | 178,000 |
| Izod Impact Strength, ft-lb/in Notched, 72° F. | 0.57 |
| Thermal Properties | |
| Deflection Temperature, °C. | |
| 66 psi | 110° C. |
| 264 psi | 66° C. |
| Coefficient of Linear Thermal Expansion, in/in/°F. | $5 \times 10^{-5}$ |

The construction of the nozzle cap 20 and nose bushing 22 using two similar rigid injected molded parts provides a wider compatibility window for the dispensing of a wider variety of chemical products from the nozzle assembly 18 than can be dispensed with a nozzle assembly including a part or parts made of softer plastic materials.

The construction of the nozzle assembly 18 described above also allows a sealing structure and a swirl chamber configuration to be designed in one integral unitary part, namely the nose bushing 22. Prior art sprayers require a nozzle, cap, a nose bushing, an elastic sealing member (spinner head in a one piece spinner assembly), an internal body, and finally a shroud or cover for completing the cosmetic shape of the sprayer. The unitary one piece nose bushing 22 having sealing structure and a swirl chamber configuration that provides, with the nozzle cap 20, effective liquid seals between hard plastic parts as well as ease of turning or rotation of the nozzle cap 20 relative to the nose bushing 22 provides a significant improvement over prior art nozzle assemblies.

The ability to maintain a reasonably "easy to turn" nozzle cap without using a softer more flexible plastic material is accomplished through the design of the double seal surfaces of the nose bushing 22. The nozzle cap 20 is injection molded from general polypropylene with a density of g/cc of 0.90 which is a hard surface plastic. The nose bushing 22 is injection molded from either the same material or an acetyl copolymer. The seal designs of the portions of the nozzle assembly 18 allow for the materials to conform to their assembled confined position and also maintain a leak proof seal. The design of the two hard surface material seals allow for the easy turning of the nozzle cap 20 after assembly of the nozzle assembly 18. The interference fit design of the double seals allows some flexing movement in the seals which allows the nozzle cap 20 easily to be turned and yet maintains a seal to prevent leakage over time.

From the foregoing description, it will be apparent that the nozzle assembly 18 including the nozzle cap 20 and the unitary or integral nose bushing 22 of the present invention has a number of advantages, some of which have been described above and others of which are inherent in the invention. Also it will be understood that modifications can be made to the nozzle assembly 18 including the nozzle cap 20 and the integral nose bushing 22 described above without departing from the teachings of the present invention. Accordingly, the scope of the invention is only to be limited as necessitated by the accompanying claims.

We claim:

1. A nozzle assembly for mounting to the front end of a trigger sprayer, said assembly comprising:

a nozzle cap made of relatively hard, rigid plastic material;

an integral nose bushing made of relatively hard, rigid plastic material on which said nozzle cap is threadedly received; and, said nozzle cap and said integral nose bushing being capable of forming three sealing relationships with each other, the first sealing relationship being between a rear surface of a rearwardly extending cylindrical projection in said nozzle cap and a bottom wall of a swirl cavity at the forward end of said nose bushing, the second sealing relationship being between an outer cylindrical wall of said cylindrical projection extending rearwardly from said nozzle cap and an inner cylindrical wall surface of an annular wall defining said swirl cavity; and the third sealing relationship being between at least one of inner and outer cylindrical surfaces of an outer cylindrical flange of said nose bushing and at least one of radially facing inner and outer cylindrical wall surfaces of an annular slot in said cap.

2. A nozzle assembly consisting essentially of two pieces only, they being:

a nozzle cap made of relatively hard, rigid plastic material; and, an integral nose bushing made of relatively hard, rigid plastic material on which said nozzle cap is threadedly received; and, said nozzle cap and said integral nose bushing being capable of forming three sealing relationships with each other, the first sealing relationship being between a rear surface of a rearwardly extending cylindrical projection in said nozzle cap and a bottom wall of a swirl cavity at the forward end of said nose bushing, the second sealing relationship being between an outer cylindrical wall of said cylindrical projection extending rearwardly from said nozzle cap and an inner cylindrical wall surface of an annular wall defining said swirl cavity; and the third sealing relationship being between at least one of inner and outer cylindrical surfaces of an outer cylindrical flange of said nose bushing and at least one of radially facing inner and outer cylindrical wall surfaces of an annular slot in said cap.

3. The nozzle assembly of claim 2 wherein said integral nose bushing includes a body portion that is received and mounted in a body of a trigger sprayer and a bushing portion integral with said body portion, said bushing portion including an outer generally cylindrical portion having a distal end and a proximal end, said proximal end having threads thereon and said distal end having a smooth outer cylindrical surface; said outer generally cylindrical portion having an annular slot therein thereby defining said outer cylindrical flange and a central cylindrical portion; said central cylindrical portion having an outer end which extends outwardly of said outer cylindrical flange and which has an outer end having an annular wall defining therein said swirl cavity; said bushing portion having a waterway extending longitudinally through said bushing portion to at least an area adjacent said annular slot; and, said nose bushing having passage means therein communicating said waterway with said annular slot in said cylindrical portion.

4. The of claim 3 wherein said nozzle cap includes a generally cylindrical skirt formation extending rearwardly from a front wall of said cap;

said front wall having an orifice extending through said front wall;

said generally cylindrical skirt formation including an internal threaded portion which is adapted to mate with threads on said threaded portion of said nose bushing;

said nozzle cap having on a rear surface of said front wall said axially rearwardly extending annular projection which surrounds said orifice and which is sized to be received in and seal with said inner cylindrical wall surface of said annular wall defining said swirl cavity.

5. The nozzle assembly of claim 2 wherein said nozzle cap includes a generally cylindrical skirt formation extending rearwardly from a front wall of said cap; said front wall has an orifice extending through said front wall; said generally cylindrical skirt formation includes an internal threaded portion which is adapted to mate with threads on a threaded portion of said nose bushing; said nozzle cap having on a rear surface of said front wall said axially rearwardly extending annular projection which surrounds said orifice and which is sized to be received in and seal with said inner cylindrical wall surface of said annular wall defining said swirl cavity in said nose bushing; and, said cap having said axially extending annular slot which extends from a back side of said cap into said cap and which is constructed and arranged to receive said cylindrical flange of said nose bushing and seal with said inner and outer cylindrical surfaces thereof.

6. The nozzle assembly of claim 2 wherein at least one of said nozzle cap and said nose bushing is made of polypropylene.

7. The nozzle assembly of claim 6 wherein both said nozzle cap and said nose bushing are made of polypropylene.

8. The nozzle assembly of claim 6 wherein said polypropylene is grade PP-1154 polypropylene.

9. The nozzle assembly of claim 2 wherein at least one of said nozzle cap and said nose bushing is made of an acetal copolymer.

10. A nozzle assembly comprising two pieces, they being:

an integral nose bushing made of a relatively hard, rigid plastic material; and, a nozzle cap made of a relatively hard, rigid plastic material received on said nose bushing;

said integral nose bushing including a body portion that is received and mounted in a body of a trigger sprayer and a bushing portion integral with said body portion, said bushing portion including an outer generally cylindrical portion having a distal end and a proximal end, said proximal end having threads thereon and said distal end having a smooth outer cylindrical surface;

said outer generally cylindrical portion having an annular slot therein thereby defining an outer cylindrical flange and a central cylindrical portion; said central cylindrical portion having an outer end which extends outwardly of said outer cylindrical flange and which has an outer end having an annular wall defining therein a swirl cavity;

said bushing portion having a waterway extending longitudinally through said bushing portion to at least an area adjacent said annular slot;

said nose bushing having passage means therein communicating said waterway with said annular slot in said cylindrical portion;

said nozzle cap including a generally cylindrical skirt formation extending rearwardly from a front wall of said cap;

said front wall having an orifice extending through said front wall;

said generally cylindrical skirt formation including an internal threaded portion which is adapted to mate with threads on said threaded portion of said nose bushing; and, said nozzle cap having on a rear surface of said front wall an axially rearwardly extending annular projection which surrounds said orifice and which is sized to be received in and seal with the walls of said swirl cavity;

said nozzle cap has an axially extending annular slot which extends from a back side of said cap into said cap and which receives said cylindrical flange of said integral nose bushing and seals with the inner and outer cylindrical surfaces thereof; and, said nozzle cap and said integral nose bushing being capable of forming three sealing relationships with each other, the first sealing relationship being between a rear surface of said small cylindrical projection of said nozzle cap and a bottom wall of said swirl cavity, the second sealing relationship being between an outer cylindrical wall of said small cylindrical projection and an inner cylindrical wall surface of said annular wall defining said swirl cavity; and a third sealing relationship between at least one of inner and outer cylindrical surfaces of said outer cylindrical flange of said nose bushing and at least one of radially facing inner and outer cylindrical wall surfaces of said annular slot in said cap.

11. The nozzle assembly of claim 10 wherein said annular wall of said swirl cavity has at least one tangential slot extending to said swirl cavity.

12. The nozzle assembly of claim 10 wherein said annular wall defining therein said swirl cavity has three equally spaced tangential slots therein extending to said swirl cavity.

13. The nozzle assembly of claim 10 wherein said nozzle cap is adjustable on said nose bushing between a first position where said cap is fully rotated onto said nose bushing and said first, said second and said third sealing relationships provide an off position of said nozzle cap to a second partially unthreaded position of said nozzle cap where said second sealing relationship is partially intact but allows fluid to flow from said annular slot into said swirl cavity in a tangential path to flow out of said orifice in a generally conical spray and where said third sealing relationship is still intact and further to a third position where said cap is further unthreaded from said bushing where said third sealing relationship only is intact and wherein fluid can flow not only into said swirl cavity and out the discharge orifice, but also over said annular wall defining therein said swirl cavity and out said discharge orifice in a stream.

14. The nozzle assembly of claim 10 wherein at least one of said nozzle cap and said nose bushing is made of polypropylene.

15. The nozzle assembly of claim 14 wherein both said nozzle cap and said nose bushing are made of polypropylene.

16. The nozzle assembly of claim 14 wherein said polypropylene is grade PP-1154 polypropylene.

17. The nozzle assembly of claim 10 wherein at least one of said nozzle cap and said nose bushing is made of an acetal copolymer.

* * * * *